US005531334A

United States Patent [19]

Forby

[11] Patent Number: 5,531,334

[45] Date of Patent: Jul. 2, 1996

[54] RECONFIGURABLE HOOK SUPPORT

[76] Inventor: Robert G. Forby, 433 Powell Ave., Colombus, Ohio 43204

[21] Appl. No.: 347,853

[22] Filed: Dec. 1, 1994

[51] Int. Cl.[6] ..... A47F 7/00

[52] U.S. Cl. ..... 211/119; 204/297 W; 118/500

[58] Field of Search ..... 211/113, 119; 248/302, 303; 118/500; 204/297 W

[56] References Cited

U.S. PATENT DOCUMENTS

| | | | |
|---|---|---|---|
| 2,439,190 | 4/1948 | Schroeder | 204/297 W |
| 2,652,359 | 9/1953 | Schneider | 204/297 W |
| 4,037,727 | 7/1977 | Kunkle | 204/297 W X |
| 4,097,359 | 6/1978 | Davitz | 204/297 W |
| 4,217,853 | 8/1980 | Davitz | 211/119 X |
| 4,243,146 | 1/1981 | Davitz | 211/119 X |
| 4,899,966 | 2/1990 | Antos et al. | 204/297 W X |
| 5,147,050 | 9/1992 | Cullen | 204/297 W X |

*Primary Examiner*—Robert W. Gibson, Jr.

[57] ABSTRACT

A support for suspending parts during a coating procedure. The inventive device includes an elongated bar securable to a supporting structure. A plurality of mounting assemblies extend from the elongated bar for mounting a plurality of hooks depending therefrom. The mounting assemblies each include a plurality of L-shaped brackets secured to the elongated bar which cooperate to engage an individual hook.

7 Claims, 3 Drawing Sheets

FIG. 1
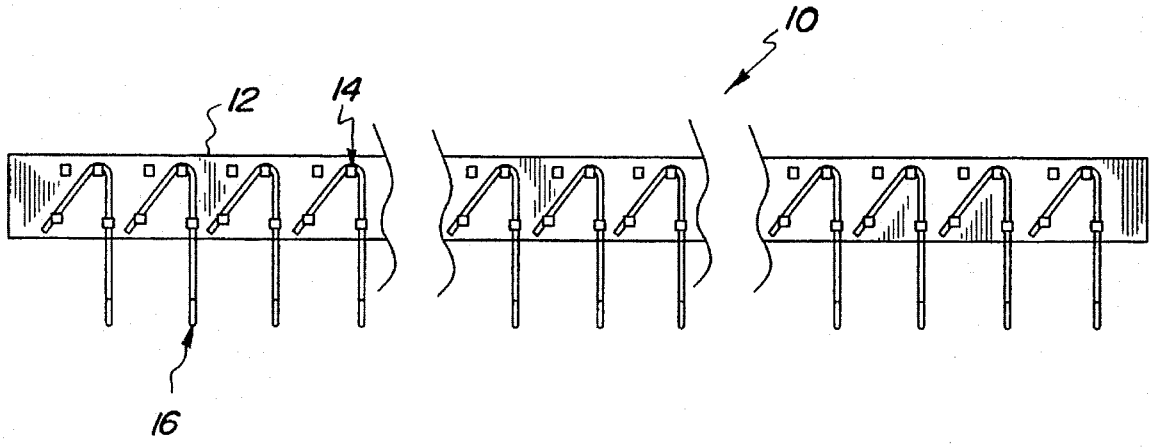
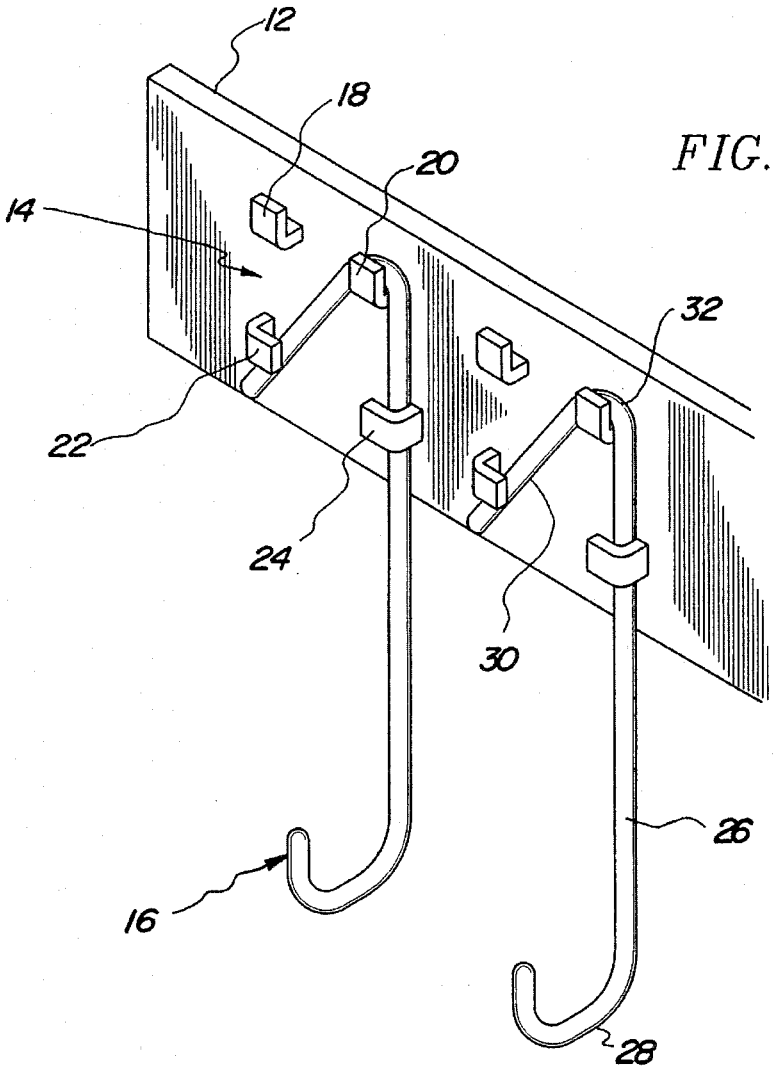
FIG. 2

RECONFIGURABLE HOOK SUPPORT

BACKGROUND OF THE INVENTION

1. Field of the Invention

The present invention relates to supporting structures and more particularly pertains to a reconfigurable hook support for suspending parts during a coating procedure.

2. Description of the Prior Art

The use of supporting structures is known in the prior art. More specifically, supporting structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art supporting structures include U.S. Pat. No. 3,785,952; U.S. Pat. No. 4,037,727; U.S. Pat. No. 4,088,559; U.S. Pat. No. 5,084,155; and U.S. Pat. No. 4,591,420.

While these devices fulfill their respective, particular objectives and requirements, the aforementioned patents do not disclose a reconfigurable hook support for suspending parts during a coating procedure which includes an elongated bar securable to a supporting structure, and a plurality of mounting means extending from the elongated bar for mounting a plurality of hook means depending therefrom, wherein the mounting means each include a plurality of L-shaped brackets secured to the elongated bar which cooperate to engage an individual one of the hook means.

In these respects, the reconfigurable hook support according to the present invention substantially departs from the conventional concepts and designs of the prior art, and in so doing provides an apparatus primarily developed for the purpose of suspending parts during a coating procedure.

SUMMARY OF THE INVENTION

In view of the foregoing disadvantages inherent in the known types of supporting structures now present in the prior art, the present invention provides a new reconfigurable hook support construction wherein the same can be utilized for suspending parts during a coating procedure. As such, the general purpose of the present invention, which will be described subsequently in greater detail, is to provide a new reconfigurable hook support apparatus and method which has many of the advantages of the supporting structures mentioned heretofore and many novel features that result in a reconfigurable hook support which is not anticipated, rendered obvious, suggested, or even implied by any of the prior art supporting structures, either alone or in any combination thereof.

To attain this, the present invention generally comprises a support for suspending parts during a coating procedure. The inventive device includes an elongated bar securable to a supporting structure. A plurality of mounting assemblies extend from the elongated bar for mounting a plurality of hooks depending therefrom. The mounting assemblies each include a plurality of L-shaped brackets secured to the elongated bar which cooperate to engage an individual hook.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reconfigurable hook support apparatus and method which has many of the advantages of the supporting structures mentioned heretofore and many novel features that result in a reconfigurable hook support which is not anticipated, rendered obvious, suggested, or even implied by any of the prior art supporting structures, either alone or in any combination thereof.

It is another object of the present invention to provide a new reconfigurable hook support which may be easily and efficiently manufactured and marketed.

It is a further object of the present invention to provide a new reconfigurable hook support which is of a durable and reliable construction.

An even further object of the present invention is to provide a new reconfigurable hook support which is susceptible of a low cost of manufacture with regard to both materials and labor, and which accordingly is then susceptible of low prices of sale to the consuming public, thereby making such reconfigurable hook supports economically available to the buying public.

Still yet another object of the present invention is to provide a new reconfigurable hook support which provides in the apparatuses and methods of the prior art some of the advantages thereof, while simultaneously overcoming some of the disadvantages normally associated therewith.

Still another object of the present invention is to provide a new reconfigurable hook support for suspending parts during a coating procedure.

Yet another object of the present invention is to provide a new reconfigurable hook support which includes an elongated bar securable to a supporting structure, and a plurality of mounting means extending from the elongated bar for mounting a plurality of hook means depending therefrom, wherein the mounting means each include a plurality of L-shaped brackets secured to elongated bar which cooperate to engage an individual one of the hook means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevation view of a reconfigurable hook support according to the present invention.

FIG. 2 is an enlarger isometric illustration of a portion of the present invention.

FIG. 3 is a cross sectional view taken along line 4—4 of FIG. 3.

DESCRIPTION OF THE PREFERRED EMBODIMENT

Figure 3:
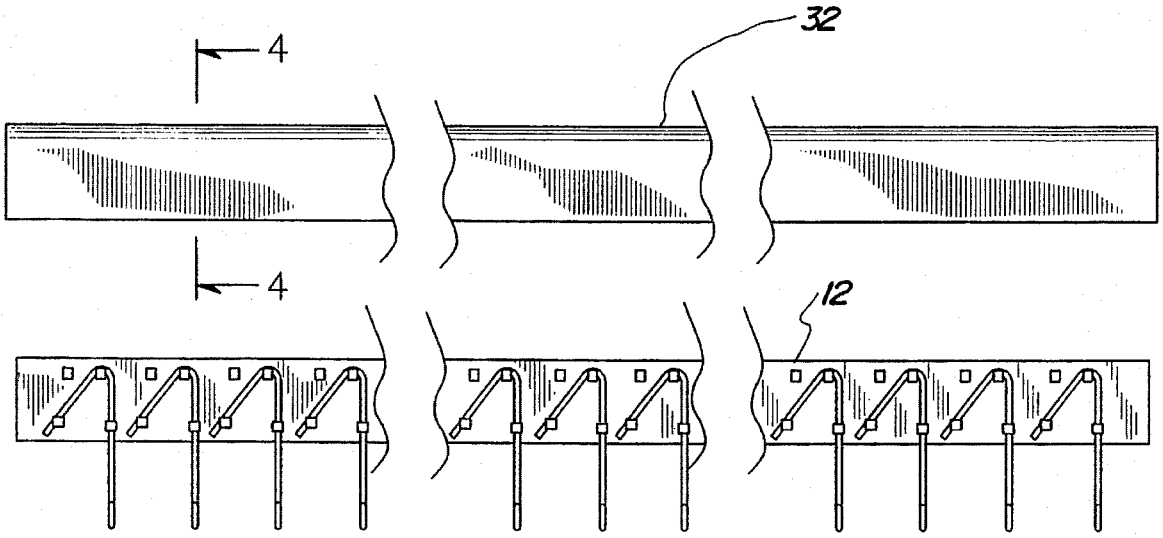
FIG. 3 is an exploded front elevation view of the present invention including a channel cover member.

With reference now to the drawings, and in particular to FIGS. 1–7 thereof, a new reconfigurable hook support embodying the principles and concepts of the present invention and generally designated by the reference numeral 10 will be described.

More specifically, it will be noted that the reconfigurable hook support 10 comprises a substantially elongated bar 12 having a plurality of mounting means 14 extending thereallong for coupling a plurality of hook means 16 thereto. The hook means 16 can each be utilized for engaging and suspending a part relative to the elongated bar 12 during a coating procedure. The elongated bar 12 can thus be coupled to a support structure, with a desired number of the hook means 16 being selectively engagable to the mounting means 14 of the elongated bar 12, whereby small parts or the like can be hung therefrom.

Referring now to FIG. 2, it can be shown that the mounting means 14 according to the present invention 10 comprises a first upper L-shaped bracket 18 secured to a front face of the elongated bar 12 and oriented so as to project towards an upper longitudinal edge thereof. Similarly, a second upper L-shaped bracket 20 is secured to the front face of the elongated bar 12 and oriented so as to project towards the upper edge thereof. The mounting means 14 further comprises a first lower L-shaped bracket 22 secured to the front face of the elongated bar 12, with a second lower L-shaped bracket 34 similarly secured thereto. The lower L-shaped brackets 22 and 24 are oriented so as to project towards one another substantially as shown in FIG. 2.

With continuing reference to FIG. 2, it can be shown that each of the hook means 16 according to the present invention 10 comprises a vertical section 26 of substantially elongated and straight configuration having a lower hook section 28 coupled to a lower end thereof and an upper angled section 30 coupled to an upper end of the vertical section by an integral bend 32. Preferably, the hook means 16 is formed entirely of a single length of wire integrally bent into the sections 26–30 as described above. The lower hook section 28 is configured to reside within a first plane, with the upper angled section 30 residing within a second plane. Preferably, the first plane is oriented so as to extend substantially orthogonally relative to the second plane such that when the upper angled section 30 and the vertical section 26 are engaged to the mounting means 14 as shown in FIG. 2, the lower hook section 28 will project substantially orthogonally from a longitudinal length of the elongated bar 12.

Each of the hook means 16 can be selectively engaged to an individual one of the mounting means 14 by positioning the integral bend 32 into one of the upper L-shaped brackets 18 or 20. The upper angled section 30 can then be engaged to one of the lower L-shaped brackets 22, whereby a resilient biasing of the vertical section 26 towards the upper angled section 30 about the particular upper L-shaped bracket 18 or 20 to which the integral bend 32 is engaged can be effected to position the vertical section 26 within another one of the lower L-shaped brackets. For example, the integral bend 32 can be positioned within the second upper L-shaped bracket, with the upper angled section 30 extending downwardly therefrom to engage the lower L-shaped bracket 22. The vertical section 26 can then be resiliently biased towards the upper angled section 30 to position the vertical section 26 into the second lower L-shaped bracket 24, whereby the hook means 16 is thus secured to the elongated bar 12 by the mounting means 14.

Figure 4:
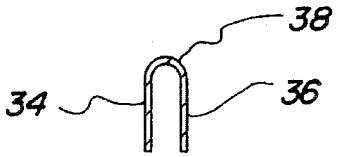

As illustrated in FIGS. 3 and 4, the present invention 10 may additionally comprise a channel cover member 32 of substantially u-shaped configuration positionable over the elongated bar 12 so as to cover the mounting means 14 thereof, as well upper portions of the hook means 16. As shown in FIG. 4, the channel cover member 32 comprises a first elongated panel 34 coupled to a second elongated panel 36 by a second integral bend 38 which positions the second elongated panel into a substantially spaced and parallel orientation relative to the first elongated panel. Thus, the channel cover member 32 can be positioned over the elongated bar 12 such that the elongated bar extends between the first elongated panel 34 and the second elongated panel 36 to preclude powder coating or spray painting of the mounting means 14 of the device 10.

Figure 5:
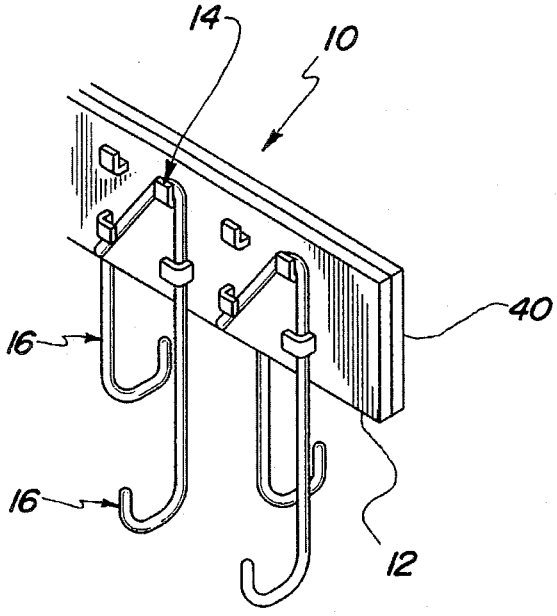
FIG. 5 is an enlarged isometric illustration of the invention including a second elongated bar secured to a first elongated bar of the invention.

Referring now to FIG. 5, it can be shown that the present invention may further comprise a second elongated bar 40 positioned in an abutting relationship relative to the first elongated bar 12 and secured thereto by any fastening means conventionally known, such as welding, or the use of threaded or driven fasteners. Preferably, the mounting means 14 of the second elongated bar 40 are positioned between the mounting means 14 of the first elongated bar 12 such that the hook means 16 of the first elongated bar are offset relative to the hook means 16 of the second elongated bar 40.

Figure 6:
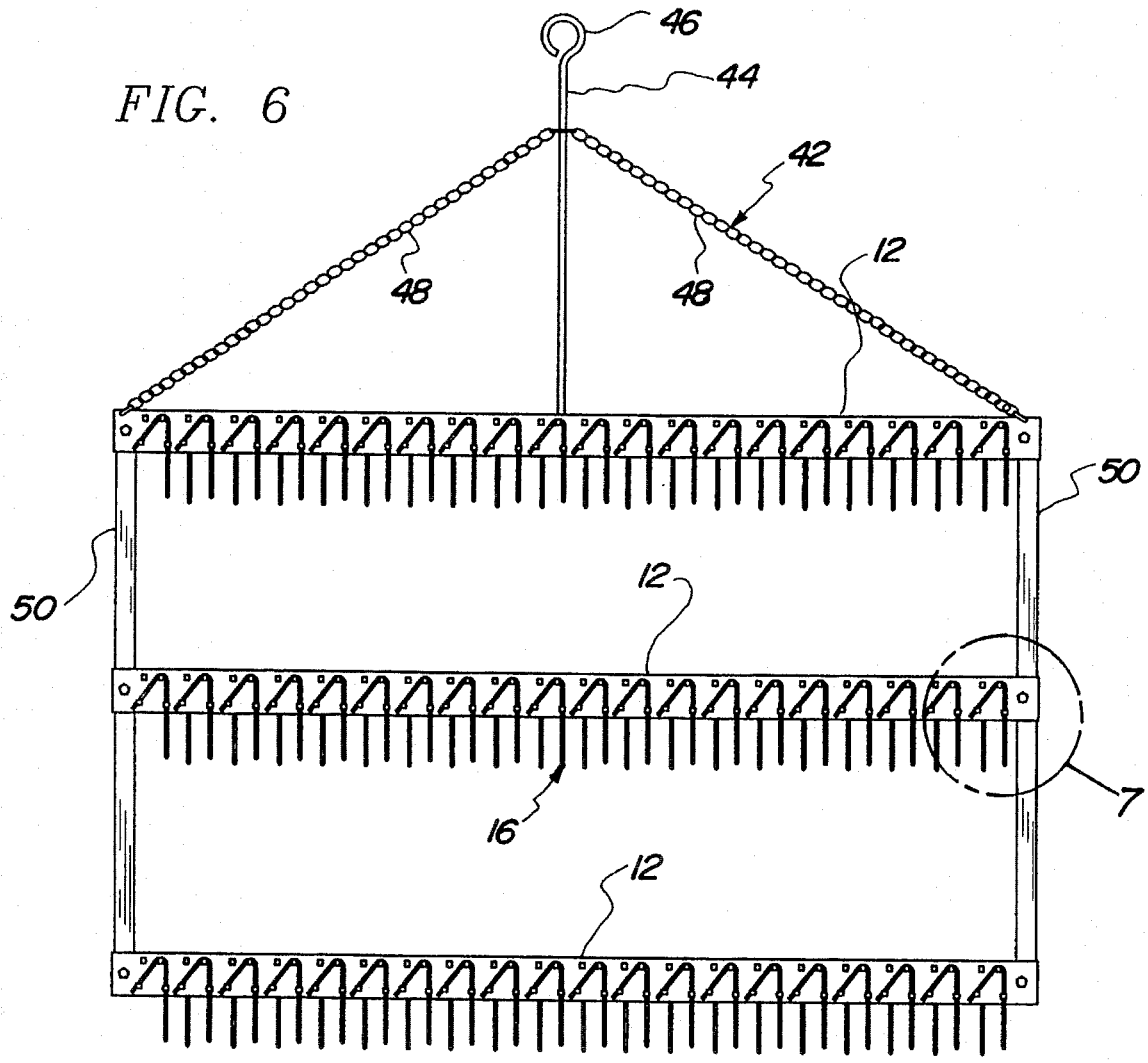
FIG. 6 is a front elevation view of the present invention further including a hanging means.
Figure 7:
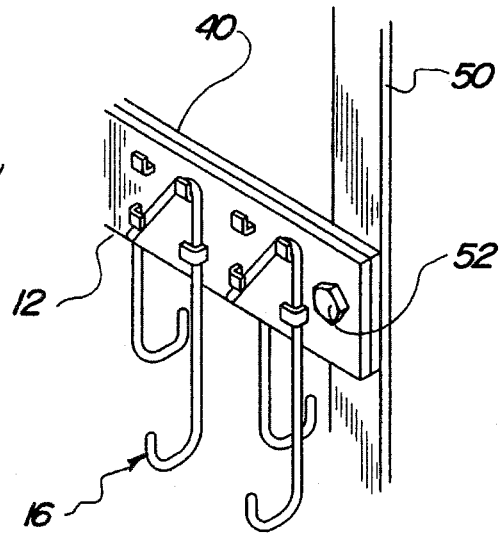
FIG. 7 is an enlarged isometric illustration of the area set forth in FIG. 6.

As shown in FIGS. 6 and 7, the present invention 10 may further comprise a hanging means 42 for supporting the elongated bars 12 and 40 relative to a supporting structure. To this end, a center support rod 44 is coupled to a center of the first elongated bar 12 and the second elongated bar 40. The center support rod 44 is shaped so as to define a hookeye 46 engagable to a supporting structure in a well understood manner. To impart stability of the center support rod 44 relative to the first elongated bar, chain braces 48 maybe coupled to the device 10 so as to extend from opposed ends of the first elongated bar 12 to a portion of the center support rod 44 proximal to the hookeye 46. Further, a plurality of elongated bars 12 and 40 can be secured in a spaced and parallel orientation relative to one another by a pair of lateral support rods 50 extending between the ends of adjacent elongated bars. As shown in FIG. 7, each lateral support rod 50 is secured to an individual end of the elongated bars 12 and 40 by a fastener 52, such as a threaded fastener, rivet, or the like.

In use, the reconfigurable hook support 10 according to the present invention can be utilized to support a plurality of parts during a powder coating, plating, or spray painting procedure. Preferably, the L-shaped brackets 18–24 of the mounting means 14 are integrally formed into the elongated bar 12 by a stamping procedure. The present invention 10 may thus be utilized in the form illustrated in FIGS. 1, 5, or 6 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A reconfigurable hook support comprising:

a plurality of hook means for engaging parts to be hung; and a substantially elongated bar having a plurality of mounting means extending therealong for coupling the hook means thereto comprising a first upper L-shaped bracket secured to a front face of the elongated bar and oriented so as to project towards an upper longitudinal edge thereof; a second upper L-shaped bracket secured to the front face of the elongated bar and oriented so as to project towards the upper edge thereof; a first lower L-shaped bracket secured to the front face of the elongated bar; and a second lower L-shaped bracket secured to the front face of the elongated bar, the lower L-shaped brackets being oriented so as to project towards one another.

2. The reconfigurable hook support of claim 1, wherein each of the hook means comprises a vertical section of substantially elongated and straight configuration having a lower hook section coupled to a lower end thereof and an upper angled section coupled to an upper end of the vertical section by an integral bend, the lower hook section being configured to reside within a first plane, with the upper angled section residing within a second plane, wherein the first plane is oriented so as to extend substantially orthogonally relative to the second plane such that when the upper angled section and the vertical section are engaged to the mounting means, the lower hook section will project substantially orthogonally from a longitudinal length of the elongated bar.

3. The reconfigurable hook support of claim 2, wherein the L-shaped brackets of the mounting means are integrally formed into the elongated bar.

4. The reconfigurable hook support of claim 3, wherein the hook means are formed a single length of wire integrally bent into the sections, wherein each of the hook means can be selectively engaged to an individual one of the mounting means by positioning the integral bend into one of the upper L-shaped brackets, the upper angled section can then be engaged to one of the lower L-shaped brackets, whereby a resilient biasing of the vertical section towards the upper angled section about the upper L-shaped bracket to which the integral bend is engaged can be effected to position the vertical section within another one of the lower L-shaped brackets.

5. The reconfigurable hook support of claim 4, and further comprising a channel cover member of substantially u-shaped configuration positioned over the elongated bar.

6. The reconfigurable hook support of claim 5, and further comprising a second elongated bar positioned in an abutting relationship relative to the first elongated bar and secured thereto.

7. The reconfigurable hook support of claim 6, and further comprising a hanging means for supporting the elongated bars relative to a supporting structure.

* * * * *